US006574949B2

(12) United States Patent
Llongueras

(10) Patent No.: US 6,574,949 B2
(45) **Date of Patent: *Jun. 10, 2003**

(54) PNEUMATIC CONTROL RING

(76) Inventor: Jordi Galan I Llongueras, Carretera Rubi, Km. 22, E-08228 Terrassa (ES)

( * ) Notice: Subject to any disclaimer, the term of this patent is extended or adjusted under 35 U.S.C. 154(b) by 0 days.

This patent is subject to a terminal disclaimer.

(21) Appl. No.: 10/057,722

(22) Filed: Jan. 24, 2002

(65) Prior Publication Data

US 2002/0116914 A1 Aug. 29, 2002

Related U.S. Application Data

(63) Continuation of application No. PCT/ES00/00269, filed on May 24, 2001.

(30) Foreign Application Priority Data

May 24, 2000 (ES) ..... 200001315

(51) Int. Cl.[7] ..... D01H 01/42
(52) U.S. Cl. ..... 57/355; 57/120

(58) Field of Search ..... 57/1 R, 58.83, 57/75, 112, 119, 120, 121, 122, 123, 124, 125, 126, 137, 352, 354, 355, 356, 357

(56) References Cited

U.S. PATENT DOCUMENTS 3,302,382 A * 2/1967 Kluttz ..... 57/120
3,866,404 A * 2/1975 Doleman et al. ..... 57/119

* cited by examiner

*Primary Examiner*—John J. Calvert
*Assistant Examiner*—Shaun Hurley

(57) ABSTRACT

The present invention is related to a pneumatic control ring (1) with application in ring twisting machines, continuous spinning frames, and double twisting frames, made of sintered, porous material and with a chamber (4) in which an air-lubricant mixture is pressure injected, which creates an air cushion between the ring (1) and the thread and produces constant and homogeneous lubrication in the contact area between them, in order to avoid the balloon effect and to prevent the thread from wearing down by friction against a surface which is the balloon control ring, facilitating high speed thread processing.

2 Claims, 1 Drawing Sheet

PNEUMATIC CONTROL RING

Figure 1:
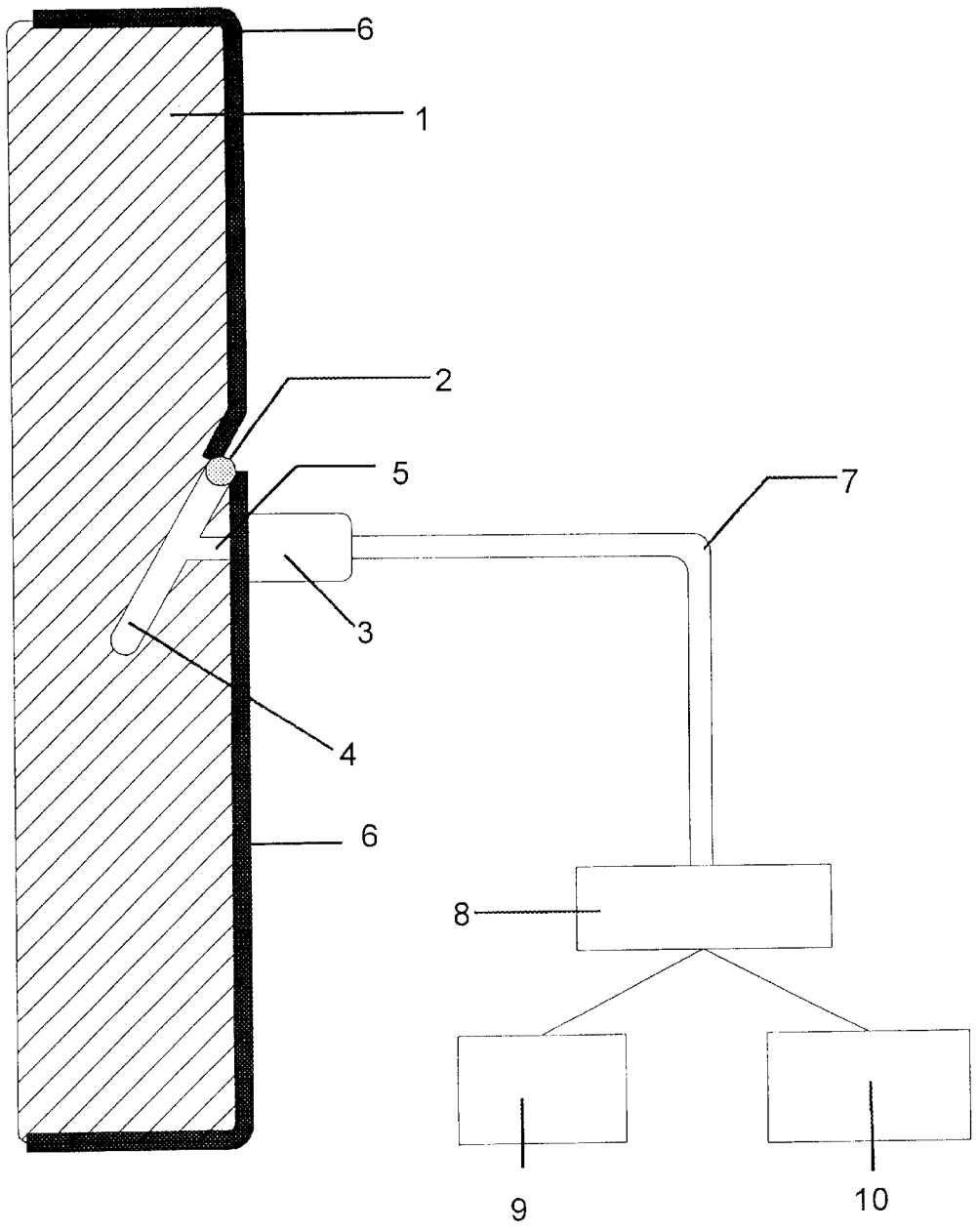

This application is a Continuation of PCT/ES00/00269 of May 24, 2001.

OBJECT OF THE INVENTION

The object of this invention, as shown by its title, is related to a pneumatic control ring with application in ring twisting machines, continuous spinning frames and double twisting frames, which, by creating an air cushion between the ring and the thread, and lubricating the contact area between them, avoids the balloon effect and prevents the thread from wearing down due to friction against the surface of the control ring of the balloon, facilitating higher processing speeds.

BACKGROUND

The current control rings for twisting and continuous spinning frames have a problem when carrying out high speed and/or delicate thread twisting due to the balloon effect. This problem causes the thread to wear down by friction against a surface which is the balloon control ring so it cannot be processed in this way, the solution being, consequentially, increasing tension to reduce the balloon so that it does not rub against the control ring, and slowing down the spindle speed.

DESCRIPTION OF THE INVENTION

The pneumatic control ring has been developed to avoid the aforementioned inconveniences that occur with twisting machines and continuous spinning frames.

The pneumatic control ring consists of a hollow, cylindrical-shaped ring made of sintered material, which is lubricated with a mixture of compressed air and lubricant from an external mixer, which in turn creates an "air cushion" between the ring and the thread.

This ring portion presents a slot on its outer surface, which is the entrance to a chamber inside the ring, being hermetically sealed and insulated by a gasket, thus avoiding any possible leakage. This chamber is only connected to the exterior by way of a cylindrical conduct, which is the entrance of the air-lubricant mixture.

This portion also includes a layer of sealing varnish on the outer surface of the ring, where no contact is made between the ring and the thread, whose purpose is to avoid any leakage of the air-lubricant mixture in this area.

The air-lubricant mixture is pressure injected into the inner chamber of the pneumatic control ring by air pressure from external sources. This pressure makes the air-lubricant mixture pass through the pores of the ring, causing a constant and homogeneous spreading of the lubricant in the ring-thread contact area.

As a consequence of air pressure, as well as the lubrication of the ring-thread contact surface caused by the lubricant, an air cushion between the ring and the thread is produced, considerably reducing rubbing and, therefore, preventing the thread from wearing down, and facilitating, as a result, higher speed thread processing due to higher balloon turning speed.

The pneumatic control ring carries out a vertical movement in relation to the machine, situating the control ring at the ideal distance between the thread guide and the spool for an adequate control over the balloon at all times.

BRIEF DESCRIPTION OF THE ILLUSTRATIONS

A preferred practical embodiment of the pneumatic control ring, object of the present invention, is described below based on the attached illustration:

FIG. 1: Revolving portion of the pneumatic control ring.

PREFERRED EMBODIMENT OF THE INVENTION

The pneumatic control ring (1) consists of a hollow, cylindrical-shaped ring made of sintered material, preferably built with material of iron, aluminium or plastic origin.

The pneumatic control ring (1) shows a degree of porosity between 0.1% and 50% relative to the volume or total specific weight of the pneumatic control ring (1).

The pneumatic control ring (1) includes an inner chamber (4). This inner chamber (4) includes a slot at one end that meets the outer wall of the ring (1) and connecting with the exterior surface, which is covered by a gasket (2) preferably made of rubber, and introduced by pressure injection into said slot, the purpose of which is to seal and insulate the inner chamber (4) from the exterior in order to avoid leakage of the air-lubricant mixture, as well as possible pressure loss. Said inner chamber (4) connects to the outside only by way of a cylindrical conduct (5), through which the air-lubricant mixture is introduced. The air-lubricant mixture is introduced by way of a preferably metallic connector (3) attached to the cylindrical conduct (5), which allows connection with the inner chamber (4) with a tube (7), preferably made of plastic, that leads the air-lubricant mixture with a predetermined pressure and mixture proportion from the mixer (8) to the connector (3) and the cylindrical conduct (5). The pneumatic control ring portion (1) includes a layer of sealing varnish (6) on a part of the outer surface of the ring (1) where no contact is made between the ring (1) and the thread, the purpose of this sealing varnish (6) being to prevent loss of the air-lubricant mixture and thus to avoid leakage.

The pressure of the air-lubricant mixture is due to the use of compressed air in making it. This pressure is gradable, and a range of pressure between 0.2 bar and 80 bar can be used. The mixture is made in an external mixer (8) outside the pneumatic control ring (1). In this mixer (8) the mixture of the lubricant, located in a tank (9), which can have a viscosity between 0'1 and 250 centistockes (measured at 40° in accordance with ISO regulations), thus allowing constant and homogeneous lubrication depending on the characteristics of the thread to be wound and the porosity index of the ring (1), and the air proceeding from an source (10) external to the ring (1). This mixer (8) facilitates the grading of the proportion of the mixture in a range between 100% air and 0% lubricant and a mixture of 0% air and 100% lubricant, depending on the characteristics of the thread and on the material the ring (1) being used is made of.

The introduction by pressure injection of the air-lubricant mixture, together with the porosity of the ring (1), facilitate the creation of an air cushion between the ring (1) and the thread, while the ring (1) simultaneously distributes the air-lubricant mixture, allowing for the homogeneous and constant lubrication of the contact surface between the ring (1) and the thread, and thus reducing the rubbing of the thread against the pneumatic control ring (1), facilitating high working speeds.

The pneumatic control ring (1) undergoes vertical movement in relation to the machine, which situates the control ring (1) at an ideal distance between the thread guide and the spool for adequate control of the balloon throughout winding.

Having sufficiently described the nature of the present invention and the process for putting it into practice, we only need add that changes in its form, materials and disposition may be introduced into its totality and each of the parts that make it up as long as said alterations do not substantially alter the characteristics of the invention claimed.

What is claimed is:

1. A pneumatic control ring for a thread passing through a center of the ring, the control ring including a hollow, cylindrical-shaped ring made of sintered material of iron, aluminum or plastic origin, the ring having an outer surface with a slot forming an entrance into an inner chamber in the ring that is sealed and insulated by a gasket located in said slot, the chamber being connected to an exterior of the ring only by way of a cylindrical conduit to which a connector is attached and through which air or an air-lubricant mixture is directed into the ring, and wherein the ring has a layer of sealing varnish on a portion of the outer surface of the ring where no contact occurs between the ring and the thread to prevent leakage of the air or air-lubricant mixture from said part of the outer surface;

the sintered material is porous; and the ring is constructed and arranged to permit the air or air-lubricant mixture to spread through the ring to provide a homogeneous and constant air cushion between the thread and a contact area on the ring.

2. The pneumatic control ring according to claim 1, wherein the degree of porosity of the ring is in the range of 0.1% to 50% of ring volume.

* * * * *